US007444105B2

(12) United States Patent
Park

(10) Patent No.: US 7,444,105 B2
(45) Date of Patent: Oct. 28, 2008

(54) IMAGE-FORMING APPARATUS WITH A TONER PRESSURE CONTROL DEVICE

(75) Inventor: Eun-sang Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 210 days.

(21) Appl. No.: 11/337,022

(22) Filed: Jan. 23, 2006

(65) Prior Publication Data

US 2006/0239721 A1 Oct. 26, 2006

(30) Foreign Application Priority Data

Apr. 22, 2005 (KR) ..... 10-2005-0033542

(51) Int. Cl.
*G03G 15/08* (2006.01)

(52) U.S. Cl. ..... 399/260

(58) Field of Classification Search ..... 399/254–263
See application file for complete search history.

(56) References Cited

U.S. PATENT DOCUMENTS

| | | | | |
|---|---|---|---|---|
| 4,122,981 A | | 10/1978 | Takeuchi et al. | |
| 5,629,758 A | * | 5/1997 | Kageyama et al. | 399/263 |
| 5,652,947 A | * | 7/1997 | Izumizaki | 399/58 |
| 6,591,079 B2 | * | 7/2003 | Ota et al. | 399/262 |

FOREIGN PATENT DOCUMENTS

| | | | |
|---|---|---|---|
| JP | 01-178988 | | 7/1989 |
| JP | 06-051632 | | 2/1994 |
| JP | 08082988 A | * | 3/1996 |
| JP | 11-030913 | | 2/1999 |
| JP | 2000066500 A | * | 3/2000 |
| KR | 10-2000-0019423 | | 4/2000 |
| KR | 10-2005-0004506 | | 1/2005 |

* cited by examiner

*Primary Examiner*—David M Gray
*Assistant Examiner*—Ryan Gleitz
(74) *Attorney, Agent, or Firm*—Roylance, Abrams, Berdo & Goodman L.L.P.

(57) ABSTRACT

An image-forming apparatus includes a developing unit. The developing unit has at least one carrying screw for uniformly distributing toner on a supply roller, a toner container that includes at least one mixing screw and supplies toner to the developing unit, and a toner pressure control device that controls the transfer of the toner by being rotatably mounted in a toner path between the developing unit and the toner container.

20 Claims, 5 Drawing Sheets

IMAGE-FORMING APPARATUS WITH A TONER PRESSURE CONTROL DEVICE

CROSS-REFERENCE TO RELATED PATENT APPLICATION

This application claims the benefit under 35 U.S.C. § 119 (a) of Korean Patent Application No. 10-2005-0033542, filed on Apr. 22, 2005, in the Korean Intellectual Property Office, the entire disclosure of which is hereby incorporated by reference.

BACKGROUND OF THE INVENTION

1. Field of the Invention

The present invention relates to an image-forming apparatus. More particularly, the present invention relates to an image-forming apparatus that has a developing unit that includes a toner pressure control device for preventing an increase in toner pressure in the developing unit.

2. Description of the Related Art

Generally, an image-forming apparatus prints a desired image on a recording medium by forming an electrostatic latent image on a photosensitive medium using an exposing unit, such as a laser scanning unit (LSU). The electrostatic latent image is developed into a toner image by using toner. The toner image is transferred and fixed on the recording medium by applying heat and pressure.

According to the type of toner and carrier used, image-forming apparatuses can be generally classified as either wet type apparatuses or dry type apparatuses. A dry type image forming apparatus can be further classified based on whether it has a one-phase developing device or a two-phase developing device.

An image forming apparatus that has a one-phase developing device forms an image by supplying only toner. In contrast, an image forming apparatus that has a two-phase developing device forms an image by supplying a mixture of toner and a carrier in which toner particles are adhered to the carrier.

An image-forming apparatus that has a one-phase developing device cleans any toner particles remaining on the surface of a photosensitive medium after developing a toner image thereon with a cleaning device, such as a cleaning blade. The toner particles are then reused in the next developing process.

An image-forming apparatus that has a two-phase developing device also reuses toner particles recovered from a surface of a photosensitive medium after developing a toner image thereon.

The above descriptions refer to black and white image formation. When forming a color image, however, toner remaining on the surface of a photosensitive medium cannot be reused since different color toners are mixed on the surface of the photosensitive medium.

To address this problem, an image-forming apparatus includes a developing unit that develops an electrostatic latent image into a toner image by supplying toner to the photosensitive medium on which the electrostatic latent image is formed. The developing unit receives toner from a toner storage space provided on the developing unit, or receives toner from a separate toner container that is connected to the developing unit.

The toner transferred to the developing unit is supplied to the photosensitive medium through a developing roller. When toner is continuously supplied to the developing unit and the developing unit is completely filled with toner, the toner pressure in the developing unit may increase. This may cause toner to leak from the developing unit and contaminate peripheral devices in the image-forming apparatus.

Therefore, there is a need for an image forming apparatus with a device that can prevent an increase in toner pressure in the developing unit by controlling the amount of toner supplied to the developing unit.

SUMMARY OF THE INVENTION

An aspect of the present invention is to address at least the above problems and/or disadvantages and to provide at least the advantages described below. Accordingly, an aspect of the present invention is to provide an image-forming apparatus having a toner pressure control device that prevents an increase in toner pressure in a developing unit by preventing continuous inflow of toner when the developing unit is full of toner.

According to an aspect of the present invention, an image-forming apparatus comprises a developing unit, a toner container, and a toner pressure control device. The developing unit comprises at least one carrying screw for uniformly distributing toner on a supplying roller, and the toner container comprises at least one mixing screw that supplies toner to the developing unit. The toner pressure control device controls the transfer of the toner by being rotatably mounted in a toner path between the developing unit and the toner container.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Figure 1:
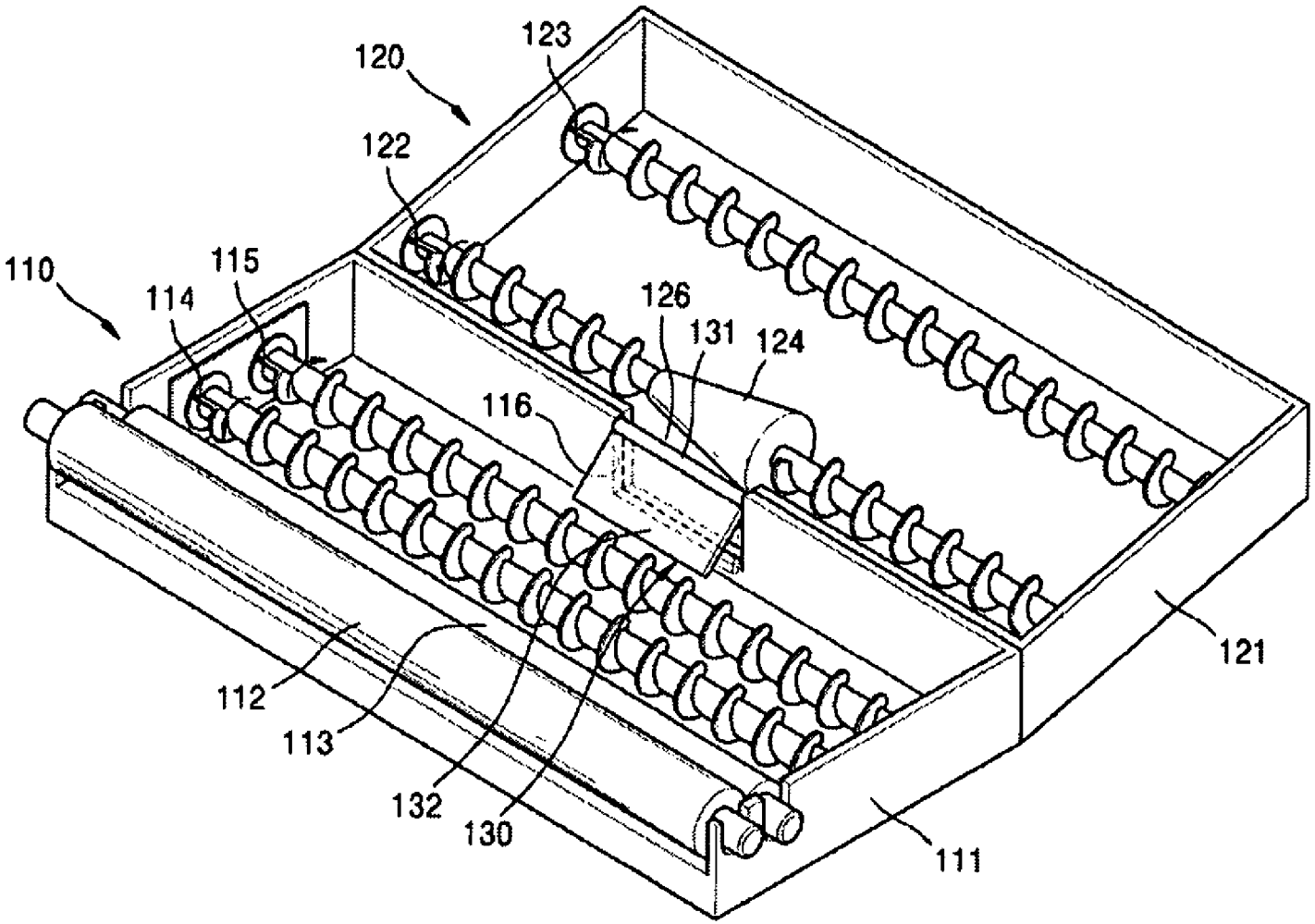
FIG. 1 is a perspective view of a developing unit and a toner container having a toner pressure control device according to an exemplary embodiment of the present invention.

FIG. 1 is a perspective view of a developing unit and a toner container having a toner pressure control device according to an exemplary embodiment of the present invention.

Referring to FIG. 1, a developing unit 110 and a toner container 120 are connected to each other so that a toner inlet 116 disposed in a developing unit housing 111 and a toner outlet 126 disposed in a toner container housing 121 correspond to each other. The toner container 120 may be connected at a predetermined angle with respect to the developing unit 110 to facilitate the transfer of toner from the toner container 120 to the developing unit 110.

A portion of the developing unit 110 includes a developing roller 112, a supplying roller 113, and a plurality of carrying screws 114 and 115. The developing roller 112 is exposed to the outside of the developing unit housing 111, and is rotatably mounted on the developing unit housing 111. The developing roller develops an electrostatic latent image formed on a photosensitive medium (not shown) into a toner image by supplying toner to the photosensitive medium. The supplying roller 113 supplies toner to the developing roller 112 and is mounted substantially parallel to the developing roller 112. The carrying screws 114 and 115 are rotatably mounted in the developing unit housing 111 and carry toner to the supplying roller 113. The carrying screws 114 and 115 carry toner in the developing unit housing 111 in a lengthwise direction of the supplying roller 113.

The carrying screws 114 and 115 carry the toner in the developing unit housing 111 by rotating in opposite directions to each other as indicated in FIG. 1.

The toner container 120 (which is filled with toner) is detachably mounted to the developing unit 110, and includes a plurality of mixing screws 122 and 123 to prevent the toner from hardening.

A toner pressure control device 130 is mounted on the toner inlet 116 of the developing unit 110 to control the amount of toner being transferred to the developing unit 110 from the toner container 120. The toner pressure control device 130 allows the toner to flow into the developing unit 110 when the developing unit 110 is not full with toner. However, the toner pressure control device 130 limits the flow of toner into the developing unit 110 by blocking the toner outlet 126 when the developing unit 110 is full with toner. In this way, the toner pressure control device 130 prevents an increase of toner pressure in the developing unit 110.

The toner pressure control device 130 includes a pressure control plate 132 that is mounted on a rotation axis 131 disposed substantially parallel to the supplying roller 113 in the toner inlet 116 to block or open the toner inlet 116.

The pressure control plate 132 is mounted to contact an opening unit 124. The opening unit 124 has a conical shape and is formed on the mixing screw 122 mounted nearest to the toner outlet 126. Accordingly, when the opening unit 124 contacts the pressure control plate 132, the pressure control plate 132 rotates toward the developing unit 110. Then, the toner inlet 116 is opened by the pressure of toner entering into the developing unit 110 from the toner container 120.

In another exemplary embodiment of the present invention, the pressure control plate 132 does not contact the opening unit 124, and the pressure control plate 132 is opened by the pressure of toner transferring from the toner container 120 to the developing unit 110 since the toner container 120 is mounted in an inclined position with respect to the developing unit 110.

Figure 2:
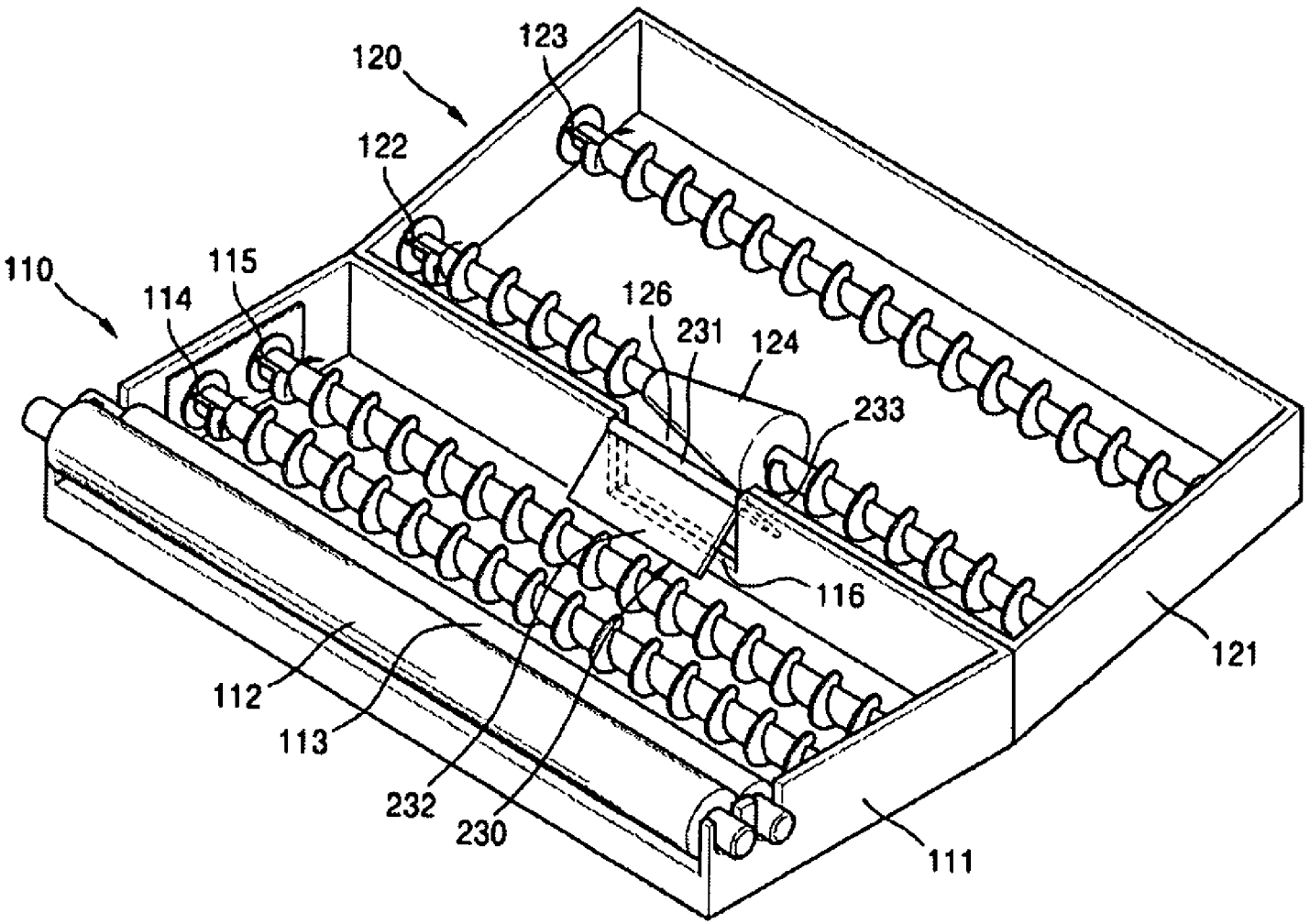
FIG. 2 is a perspective view of a developing unit and a toner container having a toner pressure control device according to another exemplary embodiment of the present invention.

FIG. 2 is a perspective view of a developing unit and a toner container having a toner pressure control device according to another exemplary embodiment of the present invention.

Referring to FIG. 2, the developing unit and the toner container have substantially identical configurations to the developing unit 110 and the toner container 120 depicted in FIG. 1. However, the toner pressure control device 230 of FIG. 2 is different from the toner pressure control device 130.

The toner pressure control device 230 includes a pressure control plate 232 rotatably mounted on a rotation axis 231 which is substantially parallel to the supplying roller 113 in the toner inlet 116. The toner pressure control device 230 also includes a rotation control plate 233 vertically connected to the pressure control plate 232 and disposed to contact the opening unit 124.

The opening unit 124 opens when the rotation control plate 233 rotates the pressure control plate 232 toward the developing unit 110 in contact with the opening unit 124, thereby facilitating the flow of toner into the developing unit 110.

The pressure control plate 232 rotates due to the pressure of toner when the developing unit 110 is full with toner, and the toner inlet 116 can be blocked when the pressure control plate 232 rotates toward the toner container 120 since the rotation control plate 233 bends when it contacts the opening unit 124. To allow this bending, the rotation control plate 233 may be formed of a soft material, such as rubber or fiber.

Figure 3:
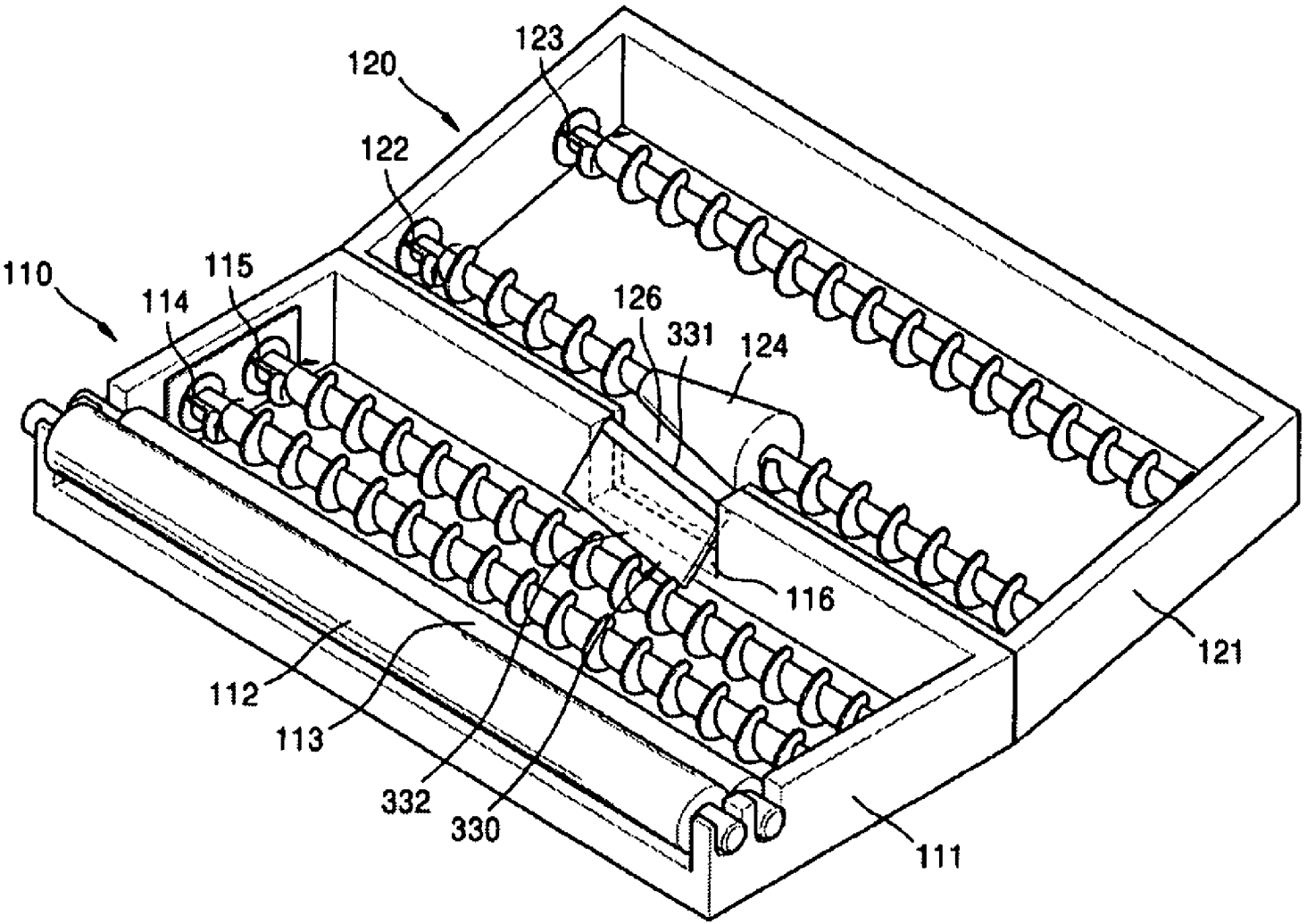
FIG. 3 is a perspective view of a developing unit and a toner container having a toner pressure control device according to still another exemplary embodiment of the present invention.

FIG. 3 is a perspective view of a developing unit and a toner container having a toner pressure control device according to still another exemplary embodiment of the present invention.

Referring to FIG. 3, the developing unit and the toner container have substantially identical configurations to the developing unit 110 and the toner container 120 depicted in FIG. 1. However, the toner pressure control device 330 of FIG. 3 is different from the toner pressure control device 130 of FIG. 1

The toner pressure control device 330 includes a pressure control plate 332 that blocks or opens the toner inlet 116. The pressure control plate 332 is rotatably mounted on a rotation axis 331 in the toner inlet 116. The rotation axis 331 is slanted at a predetermined angle with respect to the supplying roller 113.

The slant of the rotation axis 331 by a predetermined angle with respect to the supplying roller 113 allows the toner transferred by the rotation of the carrying roller 115 to reach the pressure control plate 332. This increases the contact area between the toner that is transferred to the pressure control plate 332 by the carrying roller 115 and the pressure control plate 332.

Figure 4:
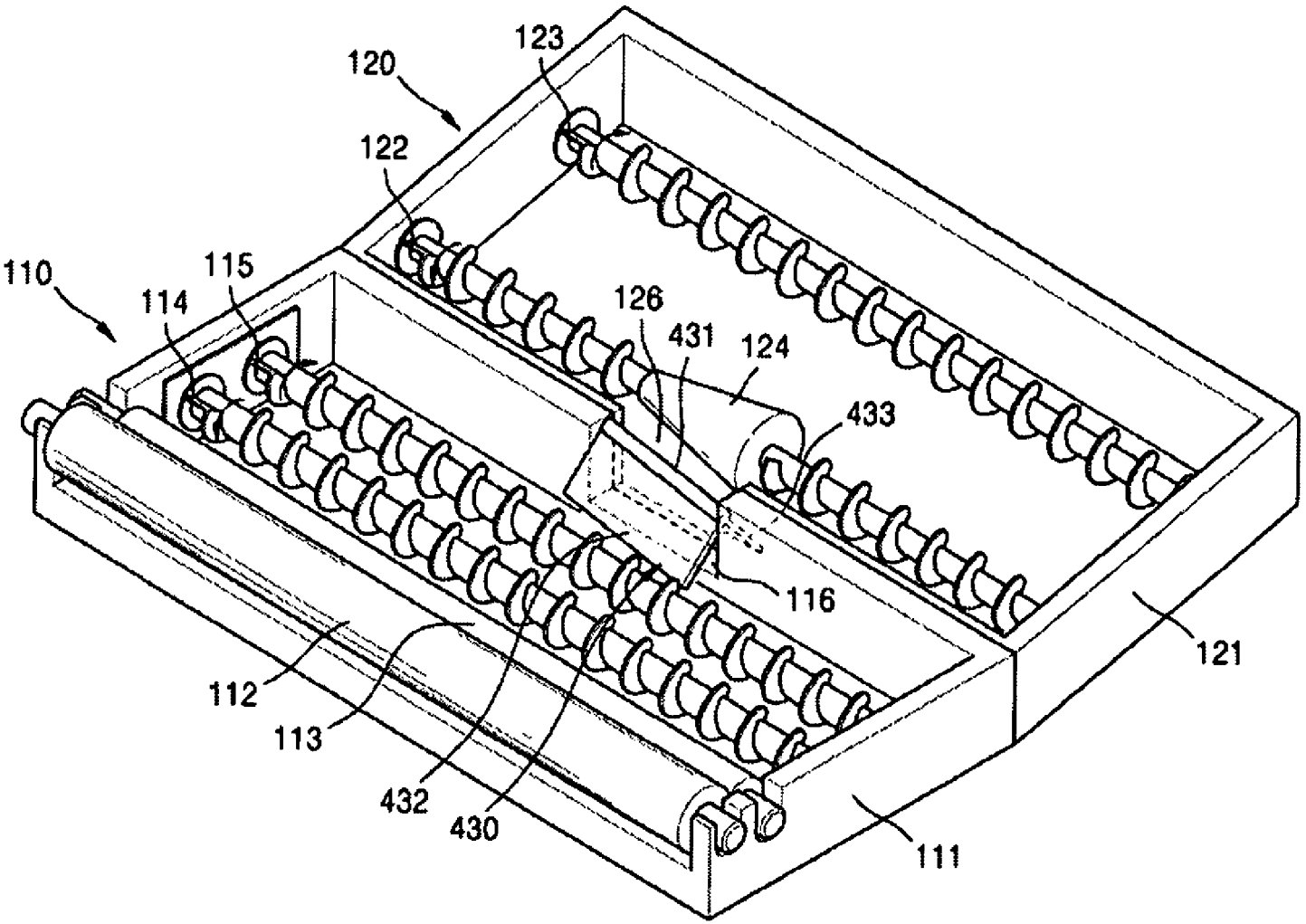
FIG. 4 is a perspective view of a developing unit and a toner container having a toner pressure control device according to yet another exemplary embodiment of the present invention.
Figure 5:
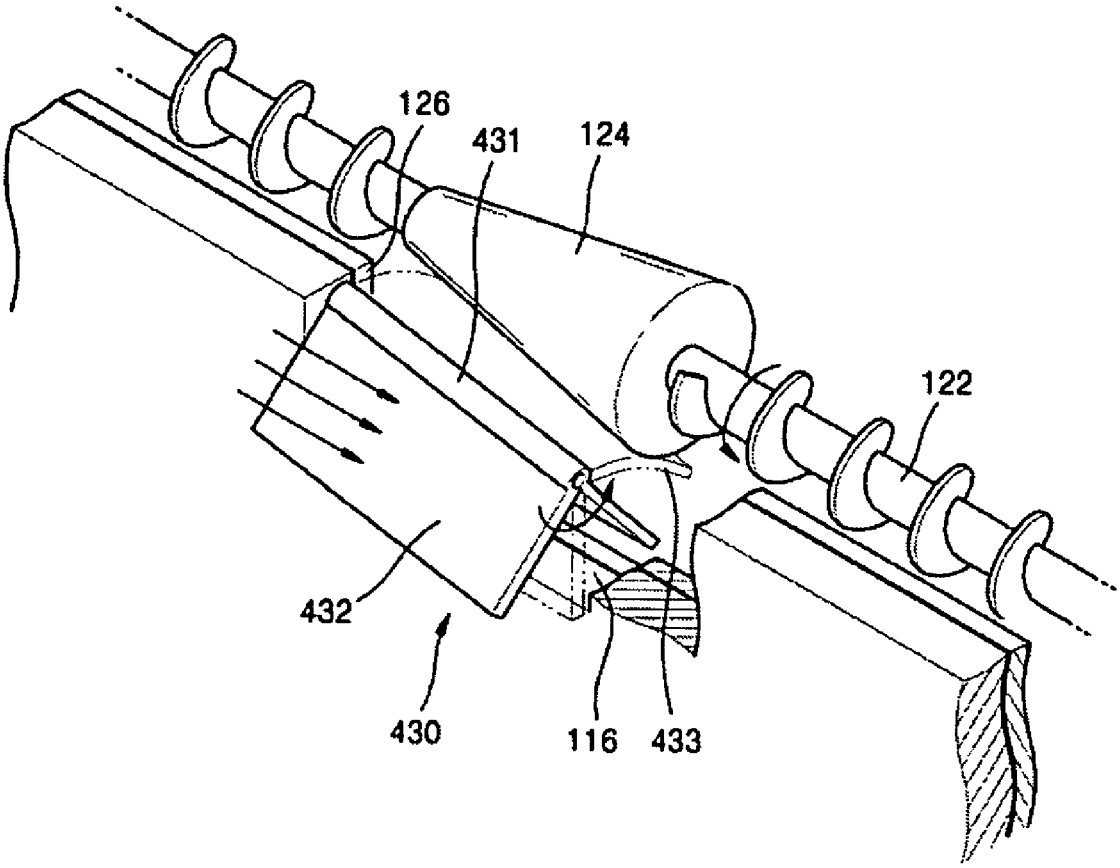
FIG. 5 is a partial perspective view illustrating the operation of the toner pressure control device depicted in FIG. 4.

FIG. 4 is a perspective view of a developing unit and a toner container having a toner pressure control device according to yet another exemplary embodiment of the present invention, and FIG. 5 is a partial perspective view illustrating the operation of the toner pressure control device depicted in FIG. 4.

Referring to FIG. 4, the developing unit and the toner container have substantially identical configurations to the developing unit 110 and the toner container 120 depicted in FIG. 1. However, the toner pressure control device 430 of FIG. 4 is different from the toner pressure control device 130 of FIG. 1.

The toner pressure control device 430 includes a pressure control plate 432 rotatably mounted on a rotation axis 431 in the toner inlet 116 and slanted at a predetermined angle with respect to the supplying roller 113. A rotation control plate 433 is vertically connected to the pressure control plate 432 and disposed to contact the opening unit 124.

The rotation axis 431 is slanted at a predetermined angle with respect to the supplying roller 113. The rotation axis 431 may be inclined parallel to an outer circumference of the opening unit 124 so that the toner transferred by the rotation of the carrying roller 115 can reach the pressure control plate 432. This increases the contact area between the toner transferred to the pressure control plate 432 by the carrying roller 115 and the pressure control plate 432. The rotation control plate 433 is preferably formed of a soft material, such as rubber or fiber.

As depicted in FIG. 5, when the developing unit 110 is full of toner, the pressure control plate 432 rotates in a counter clockwise direction due to the pressure (see arrows in FIG. 5) of the toner in the developing unit 110. When the rotation control plate 433 rotates toward the toner container 120, the rotation control plate 433 bends when contacting the opening unit 124, thereby blocking the toner inlet 116.

As described above, an image-forming apparatus according to the present invention can regulate toner pressure in the developing unit to prevent leakage of toner from the developing unit and prevent peripheral elements from being contaminated with toner.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image-forming apparatus comprising:

a developing unit that comprises at least one carrying screw for distributing toner on a supplying roller;

a toner container that comprises at least one mixing screw and supplies toner to the developing unit, the toner container being directly connected to the developing unit to form a toner path to transfer toner between the toner container and the developing unit; and a toner pressure control device mounted in the toner path between the developing unit and the toner container to prevent toner from transferring from the toner container to the developing unit when the developing unit is approximately full of toner;

wherein the mixing screw mounted nearest to the toner path further comprises an opening unit that controls the toner pressure control device.

2. An image-forming apparatus, comprising:

a developing unit that comprises at least one carrying screw for distributing toner on a supplying roller;

a toner container that comprises at least one mixing screw and supplies toner to the developing unit; and a toner pressure control device rotatably mounted in a toner path between the developing unit and the toner container to control the transfer of the toner between the toner container and the developing unit;

wherein the toner pressure control device allows toner to transfer from the toner containerto the developing unit by rotating in one direction by the pressure of toner in the toner container, and prevents toner from transferring from the toner container to the developing unit by rotating in an opposite direction by the pressure of toner in the developing unit.

3. An image-forming apparatus, comprising:

a developing unit that comprises at least one carrying screw for distributing toner on a supplying roller;

a toner container that comprises at least one mixing screw and supplies toner to the developing unit; and a toner pressure control device rotatably mounted in a toner path between the developing unit and the toner container to control the transfer of the toner between the toner container and the developing unit;

wherein the toner pressure control device comprises a pressure control plate rotatably mounted on a rotation axis disposed substantially parallel to the supplying roller in the toner path.

4. An image-forming apparatus, comprising:

a developing unit that comprises at least one carrying screw for distributing toner on a supplying roller;

a toner container that comprises at least one mixing screw and supplies toner to the developing unit; and a toner pressure control device rotatably mounted in a toner path between the developing unit and the toner container to control the transfer of the toner between the toner container and the developing unit;

wherein the mixing screw mounted nearest to the toner path further comprises an opening unit that controls the toner pressure control device.

5. The image forming apparatus of claim 4, wherein the opening unit hasa conical shape.

6. The image-forming apparatus of claim 4, wherein the toner pressurecontrol device comprises:

a pressure control plate rotatably mounted on a rotation axis disposed substantially parallel to the supplying roller in the toner path.

7. The image-forming apparatus of claim 6, wherein the toner pressurecontrol device further comprises:

a rotation control plate vertically disposed to the pressure control plate that bends when contacting the opening unit when the rotation control plate rotates under the pressure of toner in the developing unit.

8. The image-forming apparatus of claim 7, wherein the rotation control plate is formed of a soft material.

9. An image-forming apparatus, comprising:

a developing unit that comprises at least one carrying screw for distributing toner on a supplying roller;

a toner container that comprises at least one mixing screw and supplies toner to the developing unit; and a toner pressure control device rotatably mounted in a toner path between the developing unit and the toner container to control the transfer of the toner between the toner container and the developing unit;

wherein the toner pressure control device comprises a pressure control plate rotatably mounted on a rotation axis which is slanted with respect to the supplying roller.

10. The image-forming apparatus of claim 9, wherein the toner pressurecontrol device further comprises:

a rotation control plate vertically disposed to the pressure control plate that bends when contacting the opening unit when the rotation control plate rotates under the pressure of toner in the developing unit.

11. The image-forming apparatus of claim 9, wherein the toner pressurecontrol device is slanted in a direction opposite to the toner transferred by the carrying screw mounted nearest to the pressure control plate.

12. An image-forming apparatus comprising:

a developing unit with at least one carrying screw for distributing toner on a supplying roller, the developing unit having a toner inlet;

a toner container with at least one mixing screw and a toner outlet corresponding to the toner inlet of the developing unit, the toner outlet and toner inlet forming a toner path for transferring toner between the toner container and the developing unit; and a pressure control plate rotatably mounted in the toner path, the pressure of toner in the toner container causing the pressure control plate to rotate in one direction to allow toner to transfer from the toner container to the developing unit, and the pressure of toner in the developing unit causing the pressure control plate to rotate in another direction to prevent toner from transferring from the toner container to the developing unit.

13. The image-forming apparatus of claim 12, further comprising: an opening unit disposed on the at least one mixing screw to control the pressure control plate.

14. The image-forming apparatus of claim 13, further comprising: a rotation control plate disposed on the pressure control plate and disposed to contact the opening unit when the rotation control plate rotates under the pressure of toner in the developing unit, the rotation control plate bending when contacting the opening unit.

15. The image forming apparatus of claim 14, wherein the rotation control plate is formed of a soft material.

16. The image forming apparatus according to claim 14, wherein the pressure control plate rotates around an axis which is substantially parallel to the supplying roller.

17. The image forming apparatus according to claim 14, wherein the pressure control plate rotates around an axis which is angled with respect to the supplying roller.

18. The image forming apparatus according to claim 12, wherein the pressure control plate rotates around an axis which is substantially parallel to the supplying roller.

19. The image forming apparatus according to claim 12, wherein the pressure control plate rotates around an axis which is angled with respect to the supplying roller.

20. The image-forming apparatus of claim 19, further comprising: an opening unit disposed on the at least one mixing screw to control the pressure control plate.

* * * * *